US006494116B2

(12) United States Patent
Horie

(10) Patent No.: US 6,494,116 B2
(45) Date of Patent: Dec. 17, 2002

(54) STROKE ADJUSTING DEVICE FOR PRESS MACHINE

(75) Inventor: Yasuhiro Horie, Sagamihara (JP)

(73) Assignee: Aida Engineering Co., Ltd., Kanagawa (JP)

( * ) Notice: Subject to any disclaimer, the term of this patent is extended or adjusted under 35 U.S.C. 154(b) by 0 days.

(21) Appl. No.: 09/812,445

(22) Filed: Mar. 20, 2001

(65) Prior Publication Data

US 2001/0032551 A1 Oct. 25, 2001

(30) Foreign Application Priority Data

Apr. 25, 2000 (JP) ..... 2000-123428

(51) Int. Cl.[7] ..... G05G 1/00; G05G 3/00; B30B 1/00; B30B 15/06; B30B 1/26

(52) U.S. Cl. ..... 74/571 R; 74/571 M; 74/600; 100/257; 100/102

(58) Field of Search ..... 74/570, 573 R, 74/573 F, 571 M, 25, 603, 600, 595, 422, 574, 571 R, 116–117, 63, 390, 835–837; 100/102, 257, 282, 216; 83/530, 628, 615

(56) References Cited

U.S. PATENT DOCUMENTS

| | | | | | |
|---|---|---|---|---|---|
| 4,216,681 | A | * | 8/1980 | Morisawa et al. | 74/571 M |
| 4,674,357 | A | * | 6/1987 | Sugawara et al. | 74/590 |
| 4,785,732 | A | * | 11/1988 | Czapka et al. | 74/571 M |
| 4,819,474 | A | * | 4/1989 | Gober | 100/257 |
| 4,846,014 | A | * | 7/1989 | Shiga et al. | |
| 5,105,684 | A | * | 4/1992 | Imanishi | 74/600 |
| 5,127,256 | A | * | 7/1992 | Shiga et al. | 100/257 |
| 5,257,554 | A | * | 11/1993 | Shiga et al. | 76/600 |
| 5,351,576 | A | * | 10/1994 | Matsui et al. | 74/600 |
| 5,848,568 | A | * | 12/1998 | Imanishi | 100/257 |
| 5,865,070 | A | * | 2/1999 | Burnhurst et al. | 74/600 |
| 6,405,576 | B1 | * | 6/2002 | Endo et al. | 100/257 |
| 2001/0032551 | A1 | * | 10/2001 | Horie | 100/102 |

FOREIGN PATENT DOCUMENTS

| | | | |
|---|---|---|---|
| DE | 3326074 | * | 1/1985 |
| EP | 1149688 | * | 10/2001 |
| JP | 5992200 | * | 5/1984 |
| JP | 60111800 | * | 6/1985 |
| JP | 4105799 | * | 4/1992 |
| JP | 5-400 | * | 1/1993 |
| JP | 11300499 | * | 11/1999 |
| JP | 300798 | * | 10/2001 |

* cited by examiner

*Primary Examiner*—Douglas C. Butler
(74) *Attorney, Agent, or Firm*—Darby & Darby

(57) ABSTRACT

A stroke adjusting device for removing eccentric instability in an mechanical rotary system. The stroke adjusting device includes an adjustable rotation balancing weight adjustable about an eccentric bushing positioned on an eccentric shaft. The adjustable rotation balancing weight includes a weight portion adaptable to counteract the instability of the mechanical rotation system, thus minimizing vibration. A hydraulic system enables simple adjustment of the stroke adjusting device.

10 Claims, 4 Drawing Sheets

STROKE ADJUSTING DEVICE FOR PRESS MACHINE

BACKGROUND OF THE INVENTION

1. Field of the Invention

The present invention relates to a slide stroke adjusting device equipped to minimize the vibration in the rotation system of a press machine.

2. Description of the Related Art

A conventional device for adjusting the stroke of a slide for a press machine is disclosed in Japanese laid-open Utility Model Publication 7-26099.

Referring now to FIGS. 4A and 4B, showing a large end of a connecting rod 11 of a press machine (not shown). A small end of connecting rod 11 is connected with a slide of the press machine (not shown).

A liner 11A is affixed on the inside of the large end part of connecting rod 11. An eccentric bushing 2 is slidably and rotatably connected through liner 11A to connecting rod 11. An eccentric part 1A, of an eccentric shaft 1, connects and joins by an interference fit to eccentric bushing 2. A groove 5 is provided on one side of eccentric bushing 2. Groove 5 receives a fixing rod 6 movable in parallel with the axial direction of eccentric shaft 1. In other words, groove 5 and fixing rod 6 act as a fixing means to fix eccentric bushing 2 relative to connecting rod 11.

An internal gear and a hub 3 are positioned on eccentric bushing 2 opposite groove 5. Internal gear is affixed to eccentric bushing 2. Hub 3 is movable in an axial direction about eccentric shaft 1. A teeth space 7A, is formed on the outer perimeter surface of hub 3. Teeth space 7A meshes with inner teeth (not shown) of internal gear 7. Further, a collar 9 formed on eccentric shaft 1. Collar 9 acts to restrict the movement o hub 3 away from internal gear 7 and eccentric bushing 2.

A coupling body 10 is movable in the axial direction of eccentric shaft 1, away from hub 3. Coupling body 10 contacts and pushes the side surface of hub 3, to mesh the teeth (not shown) formed on the outer perimeter surface of hub 3, with the inner teeth (not show n) of internal gear 7.

An oil passage 4, through eccentric shaft 1 helps release the interference fit of eccentric part 1A with eccentric bushing 2. Pressurized oil, provided through oil passage 4 to an opening (not shown), contacts the inner surface of eccentric bushing 2. A packing 2A and a packing 2B are formed about the outer perimeter surface of eccentric part 1A where eccentric part 1A joins eccentric bushing 2. Under some conventional constructions, packing 2A and packing 2B are omitted.

A packing 3A and 3B are positioned on the inner perimeter surfaces of hub 3 where hub 3 contacts the outer perimeters of eccentric part 1A and eccentric shaft 1. An oil passage 8, is formed through eccentric shaft 1 to a surface of eccentric part 1A opposite hub 3. Oil passage 8 allows the passage of pressurized oil to urge hub 3 outward away from eccentric part 1A.

During stroke adjustment operations, fixing rod 6 is placed in groove 5, to fix the rotation of eccentric bushing 2. Pressurized oil next passes through oil passage 8. Hub 3 moves outward from eccentric part 1A toward collar 9. As a result, hub 3 no longer meshes with internal gear 7. Pressurized oil then passes through oil passage 4. Eccentric bushing 2 is partially elastically deformed. As a result, the interference fit of eccentric part 1A is released, and eccentric shaft 1 rotates to adjust the amount of eccentricity relative to eccentric bushing 2.

Referring to FIG. 4B, the top-dead center position places an eccentricity P, of eccentric part 1A with respect to eccentric shaft 1, in the position shown. The top-dead center position further places an eccentricity Q, of eccentric bushing 2 with respect to eccentric part 1A, in the position shown. Thus, a maximum stroke length is $2\times(P+Q)$. Further, a minimum stroke length is $2\times(Q-P)$.

After stroke adjustment, pressurized oil in oil passage 4 and oil passage 8 is released. The shape of eccentric bushing 2 is elastically reformed. The interference fit with eccentric part 1A re-engages. Coupling body 10 presses against hub 3 and meshes the outer perimeter teeth of hub 3 to the inner teeth of internal gear 7. Fixing rod 6 is withdrawn from groove 5, and coupling body 10 is withdrawn from hub 3 and placed on standby in a non-interfering area.

Using the described stroke adjustment process, the stroke of connecting rod 11 is adjusted. The stroke adjustment conforms to the pitch of the inner teeth of internal gear 7. Contact provided by meshing internal gear 7 with hub 3, transfers torque from eccentric part 1A to eccentric bushing 2. Torque is then transferred from eccentric bushing 2 to connecting rod 11.

Negative results arise when using the above type of conventional stroke adjustment. Under rapid stroke rate, or an increasing stroke rate, the multiple eccentric members rotate rapidly. Thus, internal centrifugal and centripetal forces result in vibration, heat, wear, shorter equipment life span, and increased maintenance costs and operation downtime.

OBJECTS AND SUMMARY OF THE INVENTION

It is an object of the invention to provide a stroke adjustment device for a press machine.

It is another object of the invention to provide a stroke adjustment device that minimizes the unbalance and vibration resulting from the rotation of conventional stroke adjusting devices.

It is another object of the invention to provide a stroke adjustment device that is adaptable to vary stroke adjustment positions.

It is another object of the present invention to provide a stroke adjustment device that both minimizes vibration from a press machine and adjusts simultaneously to stroke adjustments of the press machine.

It is another object of the present invention to provide a stroke adjustment device that is adaptable to a range of rotary systems requiring stroke adjustment and vibratory dampening.

Briefly stated, the present invention relates to a stroke adjusting device for removing instability in a mechanical rotation system. The stroke adjusting device includes an adjustable rotation balancing weight attached to an eccentric bushing positioned about an eccentric shaft. The adjustable rotation balancing weight contains a weight portion adaptable to counteract the instability of the eccentric mechanical rotation system thus minimizing vibration. A hydraulic system enables simple adjustment of the stroke adjusting device.

According to an embodiment of the present invention, there is provided a stroke adjusting rotation balancing device, comprising: an eccentric shaft portion, the eccentric shaft portion receiving a vibration from an external mechanical system, a rotation balancing eccentric bushing affixed about a first part of the eccentric shaft portion, a rotation balancing weight adjustably joined to the eccentric bushing, means for fixing the rotation balancing weight relative to the eccentric bushing, and means for adjusting the rotation balancing weight relative to the eccentric bushing and the eccentric shaft whereby the rotation balancing weight counteracts and dampens the vibration from the external mechanical system.

According to an embodiment of the present invention, there is provided a stroke adjusting and rotation balancing device, wherein: the means for adjusting includes a hydraulic circuit, and the hydraulic circuit supplying a hydraulic pressure to the eccentric bushing and the rotation balancing weight thereby allowing adjustment of the rotation balancing weight relative to the eccentric bushing to dampen the vibration.

According to an embodiment of the present invention, there is provided a stroke adjusting and rotation balancing device, wherein: the means for fixing includes a groove, the groove formed in the rotating balancing weight, the means for fixing further includes a fixing rod, the fixing rod extending from a fixed external position, and the fixing rod formed to fit into the groove, whereby the rotation balancing weight is prevented from rotation relative to the eccentric bushing thereby allowing adjustment of the rotation balancing weight relative to the eccentric bushing to dampen the vibration.

According to an embodiment of the present invention, there is provided a rotation balancing device for a press machine, comprising: a connecting rod having a large end, an eccentric bushing slidably and rotatably provided inside the large end, an eccentric shaft having a first and second side, an eccentric part formed on a first side of the eccentric shaft, the eccentric part adjustably fittable inside the eccentric bushing, the eccentric shaft receiving vibration during operation of the press machine, a rotation balancing eccentric bushing, the rotation balancing eccentric bushing affixed to a second side of the eccentric shaft, a rotation balancing weight, the rotation balancing weight adjustably joined to the rotation balancing eccentric bushing and formed to minimize vibration during operation of the press machine, means for fixing the rotation balancing weight during adjustment, and means for adjusting the rotation balancing weight relative to the rotation balancing eccentric bushing and the eccentric bushing relative to the eccentric part thereby minimizing vibration during operation of the press machine.

According to an embodiment of the present invention, there is provided a rotation balancing device for a press machine, wherein: the means for fixing includes a fixing rod affixed to an external member, the means for fixing includes a groove formed in the rotation balancing weight, and the fixing rod engagable with the groove during adjustment of the rotation balancing device thereby preventing rotation of the rotation balancing weight relative to the external member.

According to an embodiment of the present invention, there is provided a rotation balancing device for a press machine, wherein: the means for adjusting includes a first and a second hydraulic circuit, the first hydraulic circuit providing adjustment of the eccentric part relative to the eccentric bushing, the second hydraulic circuit providing adjustment of the rotation balancing eccentric bushing relative to the rotation balancing weight, and the first and second hydraulic circuits being supplied simultaneously whereby adjustment of the eccentric part and the rotation balancing eccentric bushing occur simultaneously.

According to an embodiment of the present invention there is provided a stroke adjusting device in a rotary system including a connecting rod, an eccentric bushing slidably and rotatably provided inside a first end of the connecting rod, and an eccentric shaft in which an eccentric part is joined to the eccentric bushing by an adjustable fit, the stroke adjusting device comprising: a rotation balancing eccentric bushing affixed to the eccentric shaft, a rotation balancing weight fitted to the rotation balancing eccentric bushing, the rotation balancing weight adjustable relative to the rotation balancing eccentric bushing, means for fixing the rotation balancing weight during adjustment, and a hydraulic circuit enabling the adjustment of the rotation balancing weight relative to the rotation balancing eccentric bushing whereby vibration is minimized in the rotary system.

According to an embodiment of the present invention there is provided a stroke adjusting device, wherein: the hydraulic circuit enables simultaneous adjustment of the eccentric part relative to the eccentric bushing and the rotation balancing weight relative to the rotation balancing eccentric bushing.

According to an embodiment of the present invention there is provided a stroke adjusting device, wherein: the means for fixing includes a groove portion formed on the rotation balancing weight, and a fixing rod member affixed to an external member and insertable into the groove portion to restrain rotation of the rotation balancing weight relative the eccentric shaft.

Furthermore, when conducting the operation of stroke adjustment, the interference fit of the eccentric part and the eccentric bushing is released. In the present embodiment, in addition to the interference fit of the eccentric part and the eccentric bushing, the interference fit of the rotation balancing eccentric bushing and the rotation balancing weight is release-able and adjustable. Thus, when the eccentric shaft is rotated in order to adjust the stroke, together with the rotation of the eccentric part, the rotation balancing eccentric bushing is also rotated, and the eccentricity of the rotation balancing weight changes and vibration is damped.

As a result, the eccentricity of the rotation balancing weight can be changed according to the change in eccentricity of the eccentric bushing. Therefore, regardless of the various stroke amounts, the vibration or unbalance in the rotation system may always be minimized.

In the invention according to the present embodiment, the oil pressure circuit that releases the interference fit of the eccentric bushing and the eccentric part and the oil pressure circuit that releases the interference fit of the rotation balancing eccentric bushing and the rotation balancing weight operate in common. As a result, adjustment is simplified and the time consumed in the adjustment procedure is minimized thereby minimizing costs.

The above, and other objects, features and advantages of the present invention will become apparent from the following description read in conjunction with the accompanying drawings, in which like reference numerals designate the same elements.

DESCRIPTION OF THE PREFERRED EMBODIMENTS

Figure 1:
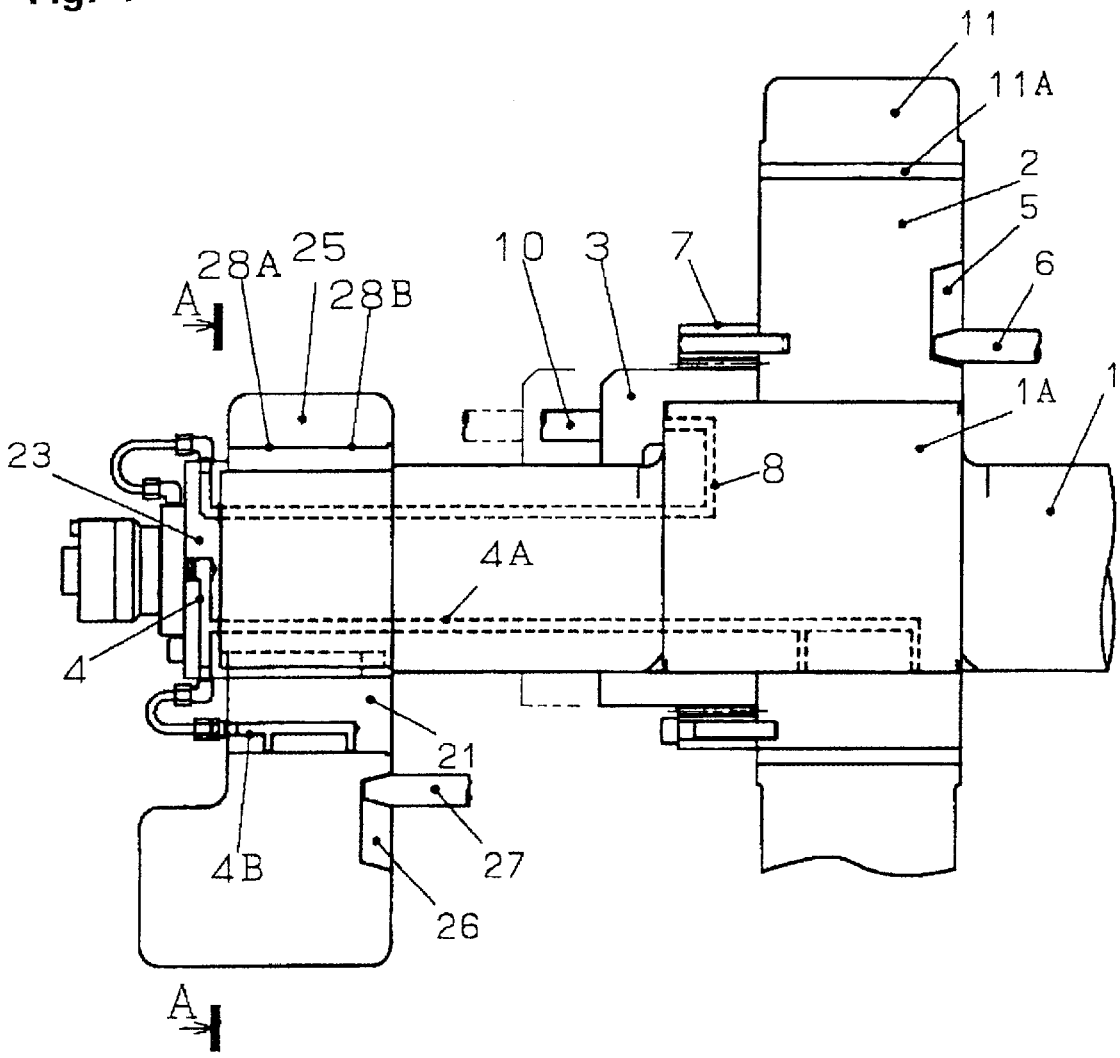
FIG. 1 is a side view of an embodiment of the present invention.
Figure 2:
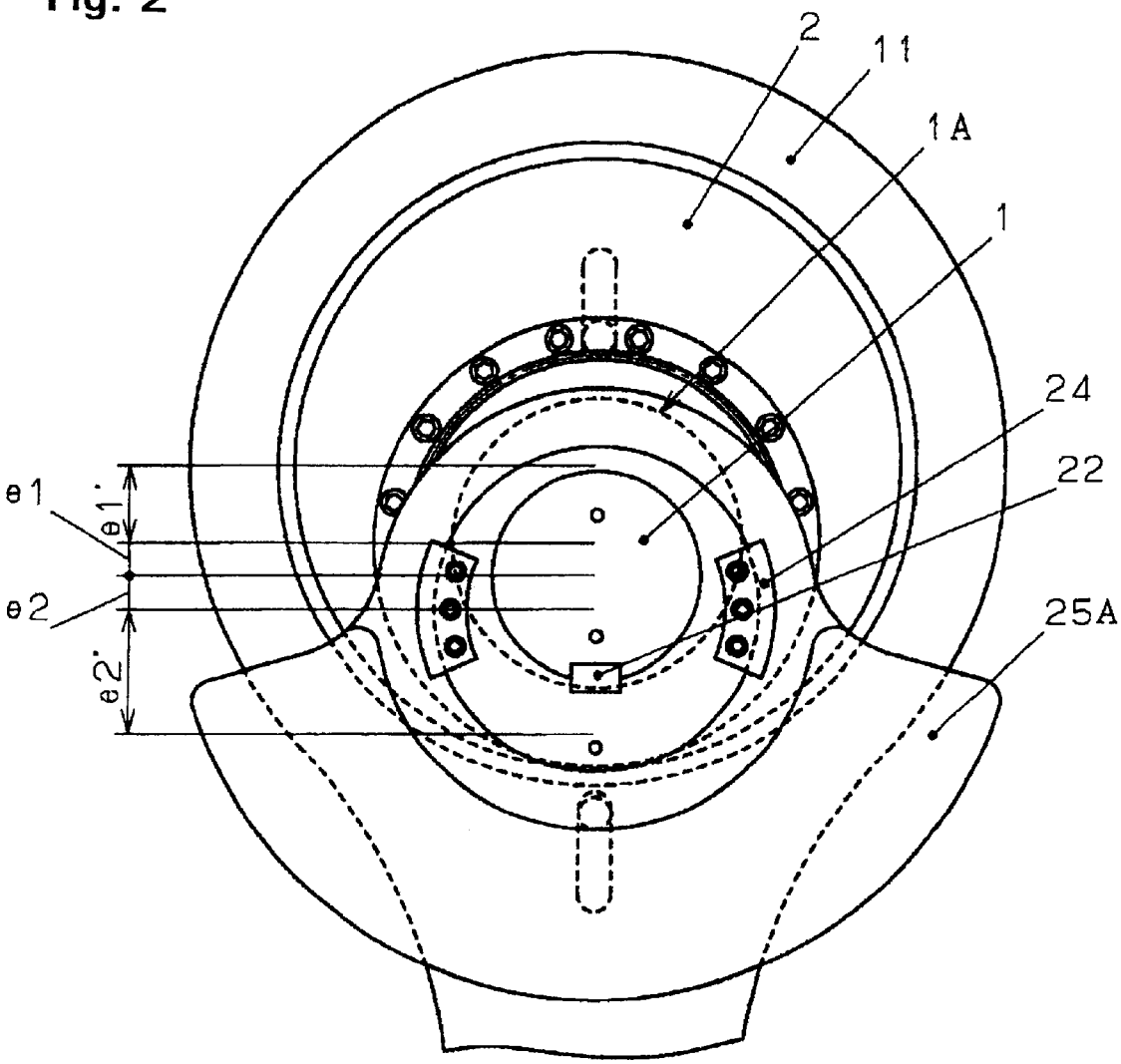
FIG. 2 is a cross-section along line A—A of FIG. 1.
Figure 4B:
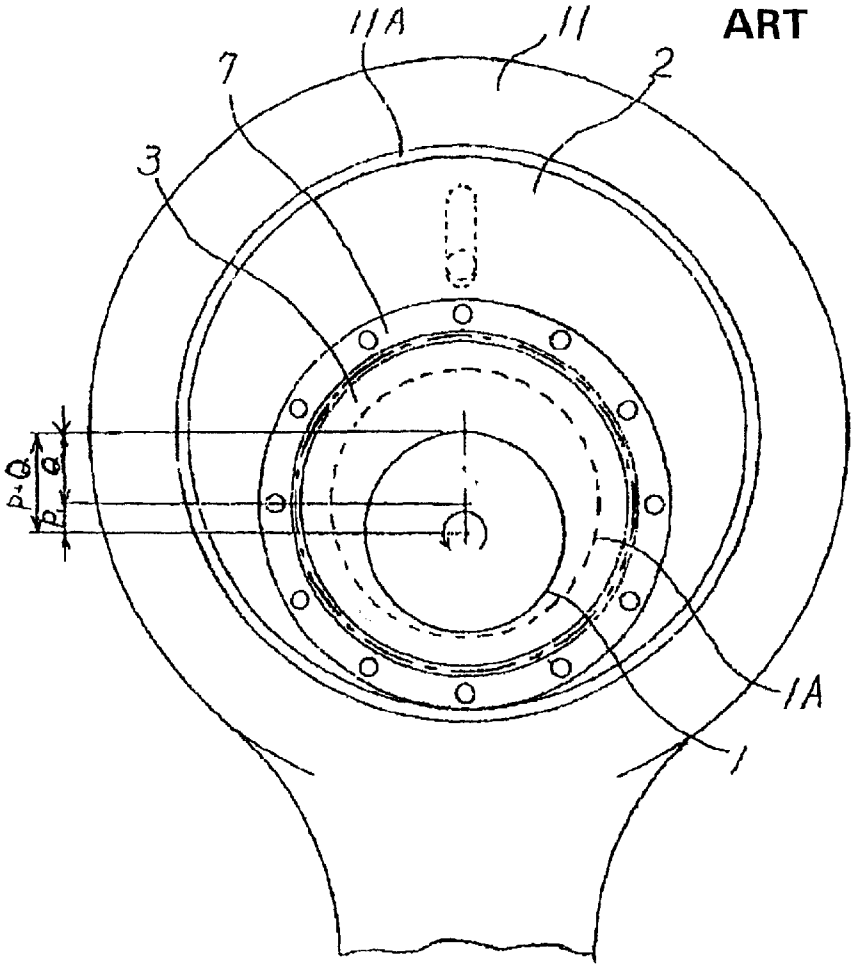
Fig. 4(B) PRIOR ART
FIG. 4(B) is a side view of the essential parts of the stroke adjustment device of a conventional embodiment.
Figure 4A:
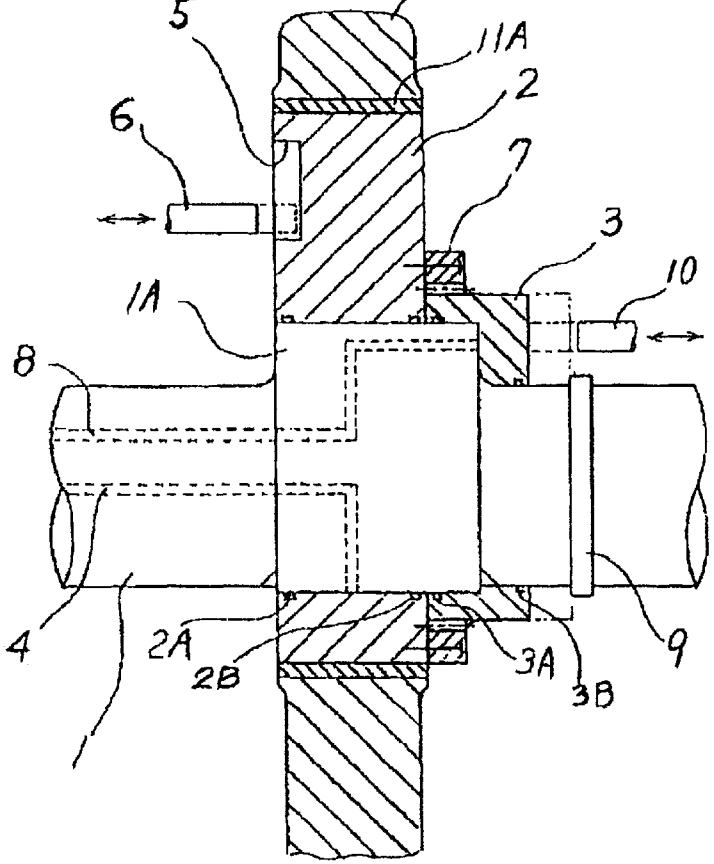
Fig. 4(A) PRIOR ART
FIG. 4(A) is a front view of a vertical cross-section of a stroke adjustment device of a conventional embodiment.

Referring now to FIGS. 1 and 2, showing a stroke adjusting device incorporating the present invention at a position of top-dead-center and maximum stroke amount. Elements 1 through 3 and 5 through 11A perform the same functions as corresponding elements in FIGS. 4(A) and 4(B). Further description of these elements is omitted.

A rotation balancing eccentric bushing 21 is affixed to eccentric shaft 1. Eccentric shaft 1 extends axially from connecting rod 11 to a shaft cover 23. A key 22, stops rotation balancing eccentric bushing 21 from rotating relative to eccentric shaft 1. Shaft cover 23 fixes rotation balancing eccentric bushing 21 to eccentric shaft 1 to prevent unplanned removal. It is to be understood that the eccentricity of rotation balancing eccentric bushing 21 is opposite the eccentricity of eccentric bushing 2.

A rotation balancing weight 25 adjoins rotation balancing eccentric bushing 21 through an interference fit. It is to be understood that an interference fit is a fit wherein the forces of friction primarily, but not completely, affix one part to another. Rotation balancing weight 25 includes weight part 25A. Weight part 25A extends from rotation balancing weight 25 away from eccentric shaft 1. A pair of stopping plates 24 contact balancing weight 25. Stopping plates 24 are on the shaft cover 23 side surface of rotation balancing eccentric bushing 21. Stopping plates 24 prevent unplanned removal of rotation balancing weight 25 from eccentric rotation balancing eccentric bushing 21.

A first packing 28A and a second packing 28B are positioned about the outer perimeter surface of rotation balancing eccentric bushing 21. First packing 28A and second packing 28B extend from rotation balancing eccentric bushing 21 to rotation balancing weight 25.

An oil passage 4B, through rotation balancing eccentric bushing 21, receives a pressurized fluid, typically oil. Oil passage 4B transmits hydraulic pressure to the interface between rotation balancing weight 25 and rotation balancing eccentric bushing 21. Oil passage 4B includes at least one opening, and as shown includes 2 openings, between packing 28A and 28B. During stroke adjustment, oil passage 4B transmits pressure to rotation balancing eccentric bushing 21. Rotation balancing eccentric bushing 21 elastically deforms and releases the interference fit with rotation balancing weight 25.

An oil passage 4A, through rotation balancing eccentric bushing 21, receives a pressurized fluid, also typically oil. Oil passage 4A transmits hydraulic pressure to the interface between eccentric bushing 2 and eccentric part 1A. During stroke adjustment, oil passage 4A transmits pressure to eccentric bushing 2. Rotation balancing bushing 2 elastically deforms and released the interference fit with eccentric part 1A.

It is to be understood that packing 28A and packing 28B may be omitted and other means provided to minimize the interference fit. It is to be further understood that oil passage 4A, and oil passage 4B are supplied from the same pressure circuit in this embodiment, but that additional or alternative hydraulic systems may be provided without changing the nature or scope of the invention.

A fixing rod 27 moves parallel to eccentric shaft 1, opposite rotation balancing weight 25. A groove 26 on rotation balancing weight 25 opposite fixing rod 27 receives and slidably engages fixing rod 27. Both fixing rod 27 and groove 26 engage to restrain the rotation of rotation balancing weight 25 relative to eccentric shaft 1 during stroke adjustment. As a result, fixing rod 27 and groove 26 serve as a means for fixing the rotation balancing weight 25 relative to eccentric shaft 1 or rotation balancing eccentric bushing 21. It is to be understood that other means for fixing the rotation of rotation balancing weight 25 may be provided according to the convenience of the manufacturer or desire of a consumer or designer.

Figure 3:
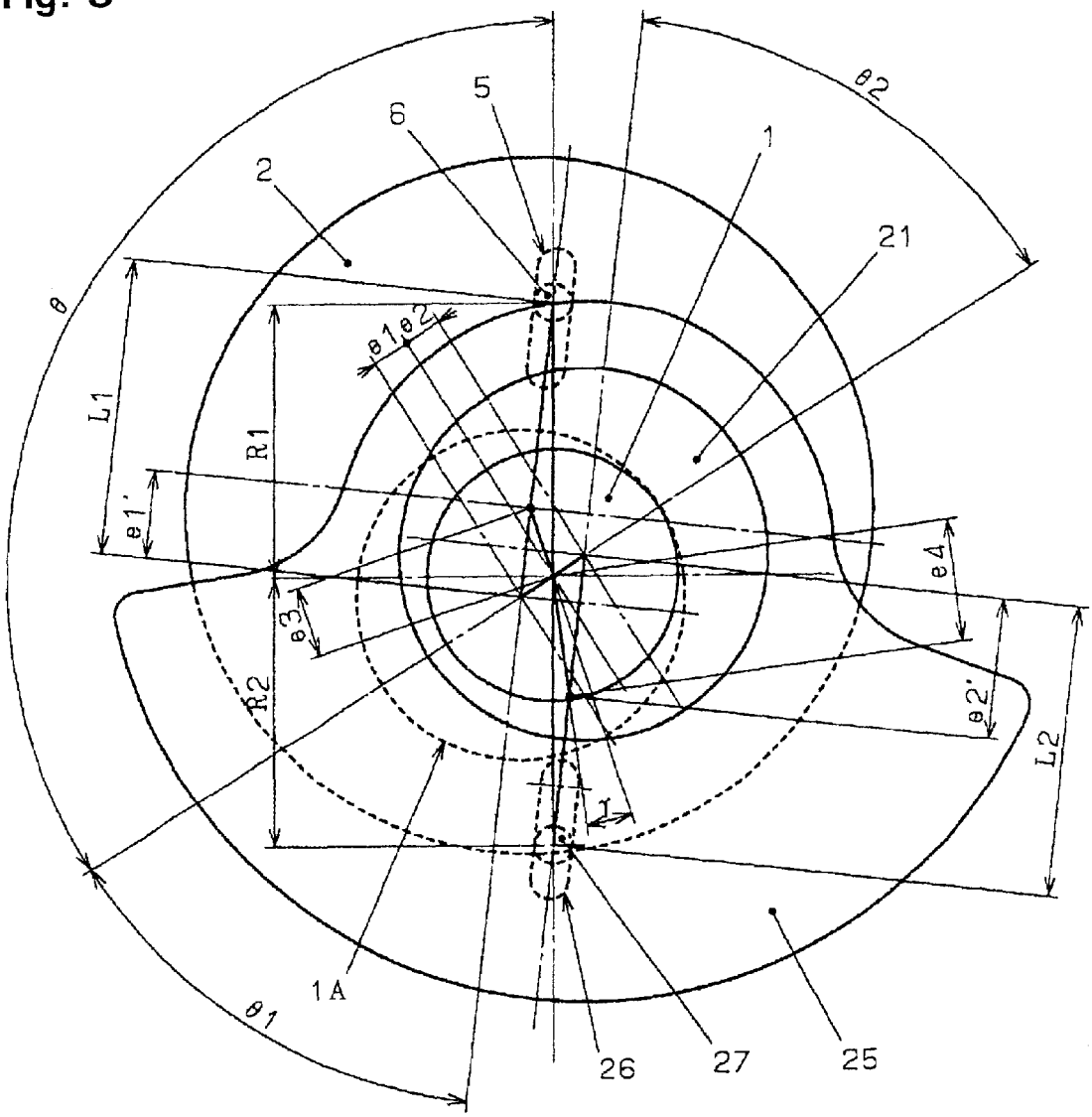
FIG. 3 is a descriptive figure of the eccentricity of the present invention.

Additionally referring now to FIG. 3 showing a distance e1, as the amount of eccentricity of eccentric part 1A. A second distance e2, is the amount of eccentricity of rotation balancing eccentric bushing 21. A first position e1', is the position of the center of gravity of eccentric bushing 2 and connecting rod 11. First position e1' is relative to the rotational center of eccentric bushing 2 and connecting rod 11. A second position e2', is the position of the center of gravity of weight part 25A, relative to the rotational center of weight part 25A. It is to be understood, that the center of gravity as used above is also the center of mas of the object described During adjustment, fixing rod 27 is inserted into groove 26 and prevents the rotation of rotation balancing weight 25. Pressurized oil, supplied through oil passage 4 pressurizes oil passage 4A and oil passage 4B. The pressurized oil releases the interference fit of eccentric part 1A and eccentric bushing 2. Eccentric part 1A is then movable relative to eccentric bushing 2. Further, the pressurized oil, sealed by packing 28A and packing 28B, elastically deforms rotation balancing eccentric bushing 21. The pressurized oil releases the interference fit between rotation balancing eccentric bushing 21 and rotation balancing weight 25. As a result, rotation balancing eccentric bushing 21 and rotation balancing weight 25 are movable relative to each other.

During adjustment of the slide stroke adjustment device, eccentric shaft 1 rotates relative to eccentric bushing 2. As eccentric shaft 1 rotates, rotation balancing eccentric bushing 21 also rotates relative to rotation balancing weight 25. Thus, in conjunction with a change in the sum of the eccentricities, of eccentric bushing 2 and eccentric part 1A, the eccentricity of rotation balancing weight 25 also changes. As a result, the eccentric vibrational forces are substantially reduced.

The rotational force, developed by eccentric bushing 2 and connecting rod 11 is described below. Further, the rotational force developed by rotation balancing weight 25, both before and after the rotation of eccentric shaft 1 is described below.

A distance R1, is the distance from the center of fixing rod 6 to the center of eccentric shaft 1. A distance R2, is the distance from the center of fixing rod 27 to the center of eccentric shaft 1. A third position e3, is the position of the center of gravity of eccentric bushing 2 and connecting rod 11 after rotating eccentric shaft 1 an angle theta (θ) from the maximum stroke, as will be explained. Angle theta is abbreviated as θ in FIG. 3. A fourth position e4, is the position of the center of gravity of weight part 25A after rotating eccentric shaft 1 angle theta (θ) from the maximum stroke, as will be explained. Further, a first weight w1 (not shown), is the total weight of eccentric bushing 2 and connecting rod 11. A second weight w2 (not shown), is the weight of weight part 25A. It is to be understood, that the term weight is interchangeable with the term mass.

As a result, a distance L1, from the center of eccentric part 1A to the center of fixing rod 6, may be calculated by the following formula:

$$L1=(e1^2+R1^2+-2\times e1\times R1\times\cos\theta)^{1/2} \quad \text{(I)}$$

Additionally, an angle theta 1 (abbreviated as θ1 in FIG. 3), is formed between distance L1 and the direction of eccentricity of eccentric part 1A. Angle theta 1(θ1 ) may be calculated by the following formula:

$$\text{Theta } 1(\theta 1)=\cos^{-1}((e1^2+L1^2-R1^2)/(2\times e1\times L1)) \quad \text{(II)}$$

As a further result, the position of the center of gravity e3 may be shown by the following formula:

$$e3=(e1^2+e1'^2-2\times e1\times e1'\times\cos\theta)^{1/2} \quad \text{(III)}$$

Thus, a first centrifugal force F1(not shown), due to the rotation of eccentric part 1A, is the following formula. In formula IV, a variable G, represents gravitational acceleration, a variable N, represents the strokes per minute of the press machine device, and a constant pi(π) represents the mathematical constant.

$$F1=w1/G\times e3\times(2\times pi\times N/60)^2 \quad \text{(IV)}$$

Further a distance L2, from the center of rotation balancing eccentric bushing 21 to fixing rod 27, is determinable from the following formula:

$$L2=(e2^2+R2^2-2\times e2\times R2\times\cos\theta)^{1/2} \quad \text{(V)}$$

Additionally, an angle theta 2 (abbreviated as θ2 in FIG. 3), is formed between distance L2 and the direction of eccentricity of rotation balancing eccentric bushing 21, is determinable from the following formula:

$$\text{Theta } 2(\theta 2)=\cos^{-1}((e2^2+L2^2-R2^2)/(2\times e2\times L2)) \quad \text{(VI)}$$

As a further result, the position of center of gravity e4 is determinable from the following formula:

$$e4=(e2^2+e2'^2-2\times e2\times e2'\times\cos\theta)^{1/2} \quad \text{(VII)}$$

Furthermore, a displacement angle gamma (abbreviated as γ in FIG. 3), of the position of center of gravity e3 and position of center of gravity e4, is determinable from the following formula:

$$\text{gamma}(\gamma)=\cos^{-1}((e1^2+e3^2-e1'^2)/(2\times e1\times e3))-\cos^{-1}((e2^2+e4^2-e2'^2)/(2\times e2\times e4)) \quad \text{(VIII)}$$

Thus, a second centrifugal force F2 (not shown), due to the rotation balancing weight 25 and directly opposes first centrifugal force F1, is determinable as follows:

$$F2=w2/G\times e4\times(2\times pi\times N/60)^2\times\cos(\gamma) \quad \text{(IX)}$$

Where e1=e2, w1=w2, e1'=e2', and R1=R2, from each of the above formulas; then e3=e4, displacement angle gamma (γ)=0, and the relationship between first and second centrifugal forces F1, F2 becomes F1=F2.

Thus, where the above-described calculations are applied to a stroke adjusting device or a vibration dampening device according to the present invention, even where the eccentricity of eccentric bushing 2 changes due to stroke adjustment, the eccentric vibration about eccentric shaft 1 may be substantially removed. As a result, device wear, mechanical fatigue, mechanical failure, noise and thermal accumulation are minimized and a comfortable and efficient work environment may be maximized. As a further result, device life is extended while allowing operation of a high precision press machine.

It is to be understood, that while the present invention is applied to a stroke adjustment device for a press machine, the instant invention is adaptable for use in multiple other situations requiring the minimization of rotational or eccentric vibration.

It is to be additionally understood that the weight and design of the rotation balancing weight 25 and the rotation balancing eccentric bushing 21 are provided at positions where the vibration or unbalance of the rotation system may be removed.

It is to be additionally understood that the above-described stroke adjusting device for a press machine may be alternatively described as a rotation balancing device.

Although only a single or few exemplary embodiments of this invention has been described in detail above, those skilled in the art will readily appreciate that many modifications are possible in the above exemplary embodiment(s) without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures. Thus although a nail and screw may not be structural equivalents, in that a nail relies entirely on friction between a wooden part and a cylindrical surface whereas a screw's helical surface positively engages the wooden part, in the environment of fastening parts, a nail and a screw may be equivalent structures.

Having described preferred embodiments of the invention with reference to the accompanying drawings, it is to be further understood that the invention is not limited to these precise embodiments, and that various changes and modifications may be effected therein by one skilled in the art without departing from the scope or spirit of the invention as defined in the appended claims.

What is claimed is:

1. A stroke adjusting device for a press machine, comprising:

a connecting rod having a large end and a stroke distance;

an eccentric bushing slidably and rotatably inside said large end;

an eccentric shaft having a first side and a second side;

an eccentric part formed on said first side;

said eccentric part adjustably provided inside said eccentric bushing;

said eccentric shaft receiving an eccentric vibration during operation of said connecting rod;

a rotation balancing eccentric bushing formed on said second side;

a rotation balancing weight adjustably joined to said rotation balancing eccentric bushing;

said rotation balancing weight formed to minimize said vibration;

means for fixing said rotation balancing weight;

first means for adjusting said eccentric bushing relative to said eccentric part whereby said stroke distance is adjusted; and second means for adjusting said rotation balancing weight relative to said rotation balancing eccentric bushing whereby said vibration is minimized; and wherein said means for fixing comprises:

a fixing rod fixed to an external member;

a groove in said rotation balancing weight; and said fixing rod rotatably engaging said groove during adjustment of said stroke adjusting device whereby the rotation balancing weight is prevented from rotating relative to said external member.

2. A stroke adjusting device for a press machine, according to claim 1, wherein:

said first means for adjusting includes at least a first hydraulic circuit;

said second means for adjusting includes at least a second hydraulic circuit;

said first hydraulic circuit providing adjustment of said eccentric part relative to said eccentric bushing;

said second hydraulic circuit providing adjustment of said rotation balancing eccentric bushing relative to said rotation balancing weight; and said first and second hydraulic circuits supplied simultaneously whereby adjustment of said eccentric part and said rotation balancing eccentric bushing occur simultaneously.

3. A rotation balancing device, comprising:

an eccentric shaft portion having at least a first part;

said eccentric shaft portion receiving a vibration from an external rotation;

a rotation balancing eccentric bushing affixed about said first part;

a rotation balancing weight adjustably joined to said eccentric bushing;

said rotation balancing weight having a weight and a shape to minimize said vibration;

means for fixing said rotation balancing weight relative to said eccentric bushing;

means for adjusting said rotation balancing weight relative to said eccentric bushing to a rotational position in which said rotation balancing weight dampens said vibration; and wherein:

said means for adjusting includes a hydraulic circuit; and said hydraulic circuit supplying a hydraulic pressure to said eccentric bushing and said rotation balancing weight thereby allowing adjustment of said rotation balancing weight relative to said eccentric bushing.

4. A rotation balancing device, according to claim 3, wherein:

said means for fixing includes a groove;

said groove formed in said rotating balancing weight;

said means for fixing further includes a fixing rod;

said fixing rod extending from a external member; and said fixing rod fittable and rotatable in said groove, whereby said rotation balancing weight is prevented from rotation thereby allowing adjusting of said rotation balancing weight relative to said eccentric bushing.

5. A stroke adjusting device in a rotary system comprising:

a connecting rod;

an eccentric bushing slidably and rotatably inside a first end of said connecting rod;

an eccentric shaft having an eccentric part joined to said eccentric bushing by an adjustable fit;

a rotation balancing eccentric bushing affixed to said eccentric shaft;

a rotation balancing weight on said rotation balancing eccentric bushing;

said rotation balancing weight adjustable relative to said rotation balancing eccentric bushing;

means for fixing said rotation balancing weight during adjustment; and a hydraulic circuit enabling said adjustment of said rotation balancing weight relative to said rotation balancing eccentric bushing to a rotational position in which vibration is minimized in said rotary system.

6. A stroke adjusting device according to claim 5, wherein:

said hydraulic circuit enables simultaneous adjustment of said eccentric part relative to said eccentric bushing and said rotation balancing weight relative to said rotation balancing eccentric bushing.

7. A stroke adjusting device according to claim 6 wherein said means for fixing comprises:

a groove formed on said rotation balancing weight;

a fixing rod member affixed to an external member; and said fixing rod insertable into said groove whereby rotation of said rotation balancing weight relative said eccentric shaft is restrained.

8. A stroke -adjusting device for a press machine comprising:

a shaft;

first and second eccentric parts spaced apart along an axis of said shaft;

eccentricities of said first and second eccentric parts being disposed 180 degrees apart;

a first eccentric bushing on said first eccentric part;

first means for adjusting a rotational relationship between said first eccentric part and said first eccentric bushing whereby a stroke of said press machine is established;

an eccentric weight on said second eccentric part;

second means for adjusting a rotational relationship of said eccentric weight and said second eccentric part; and said second means for adjusting including means for adjusting a rotational and radial position of a center of mass of said eccentric weight which substantially counteracts a rotational and radial position of a center of mass acting with said first eccentric bushing, whereby eccentric vibration of said press machine is reduced.

9. A stroke adjusting device for a press machine according to claim 8, further comprising:

a third means for adjusting; and said third means for adjusting allowing simultaneous adjustment of said rotational relationship of said eccentric weight and said second eccentric part and said rotational relationship between said first eccentric part and said first eccentric bushing whereby said adjustment occurs rapidly and said eccentric vibration is reduced.

10. A stroke adjusting device for a press machine according to claim 9, further comprising:

a fourth means for adjusting said rotational relationship of said eccentric weight and said second eccentric part and adjusting said rotational relationship between said first eccentric part and said first eccentric bushing;

said fourth means includes at least a first and a second fixing rod;

said first fixing rod engaging said eccentric bushing to prevent said eccentric bushing from rotating relative to said shaft; and said second fixing rod engaging said eccentric weight to prevent said eccentric weight from rotating relative to said shaft whereby said eccentric vibration is reduced.

* * * * *